US009726018B2

(12) United States Patent
Taguchi

(10) Patent No.: US 9,726,018 B2
(45) Date of Patent: Aug. 8, 2017

(54) SCROLL TYPE FLUID MACHINE WITH A ROTATION STOPPING MECHANISM

(71) Applicant: Sanden Holdings Corporation, Isesaki-shi, Gunma (JP)

(72) Inventor: Masanori Taguchi, Isesaki (JP)

(73) Assignee: Sanden Holdings Corporation, Isesaki-shi, Gunma (JP)

( * ) Notice: Subject to any disclaimer, the term of this patent is extended or adjusted under 35 U.S.C. 154(b) by 0 days.

(21) Appl. No.: 14/903,923

(22) PCT Filed: Jul. 10, 2014

(86) PCT No.: PCT/JP2014/068394

§ 371 (c)(1),
(2) Date: Jan. 8, 2016

(87) PCT Pub. No.: WO2015/016028

PCT Pub. Date: Feb. 5, 2015

(65) Prior Publication Data

US 2016/0160646 A1 Jun. 9, 2016

(30) Foreign Application Priority Data

Jul. 30, 2013 (JP) ..... 2013-157517

(51) Int. Cl.
*F03C 2/00* (2006.01)
*F03C 4/00* (2006.01)
(Continued)

(52) U.S. Cl.
CPC ..... *F01C 1/0253* (2013.01); *F01C 1/0215* (2013.01); *F01C 1/0269* (2013.01);
(Continued)

(58) Field of Classification Search
CPC ..... F04C 18/0215; F04C 18/0253; F04C 18/0269; F04C 23/008; F04C 29/0057;
(Continued)

(56) References Cited

FOREIGN PATENT DOCUMENTS

CN 2302451625 U 9/2012
CN 203035551 U 7/2013
(Continued)

OTHER PUBLICATIONS

The State Intellectual Property Office of the People's Republic of China, Office Action for Patent Application No. CN 201480043057.8, mailed Nov. 7, 2016.

*Primary Examiner* — Theresa Trieu
(74) *Attorney, Agent, or Firm* — Baker Botts L.L.P.

(57) ABSTRACT

A scroll type fluid machine (1) including a rotation stopping mechanism (36) for stopping rotation of a movable scroll without hindering revolving motion of the movable scroll (16) relative to a fixed scroll (14) fixed to a casing (4), the rotation stopping mechanism includes: a support hole (42) drilled in either one of a base plate (16*a*) of the movable scroll and a pedestal part (4*a*) of the casing; a rotation stopping pin (38) that is fitted into the support hole, and is protruded to the side of the other of the base plate and the pedestal part; a restriction hole (46) drilled in the other of the base plate and the pedestal part, and loosely fitted with the rotation stopping pin; and a buffer member (44) interposed between the support hole and the rotation stopping pin.

3 Claims, 3 Drawing Sheets

(51) Int. Cl.

| | |
|---|---|
| ***F04C 2/00*** | (2006.01) |
| ***F01C 1/02*** | (2006.01) |
| ***F04C 29/00*** | (2006.01) |
| ***F04C 18/02*** | (2006.01) |
| ***F04C 2/02*** | (2006.01) |
| ***F01C 17/06*** | (2006.01) |
| *F04C 23/00* | (2006.01) |

(52) U.S. Cl.
CPC ..... *F01C 17/06* (2013.01); *F04C 2/025* (2013.01); *F04C 18/0215* (2013.01); *F04C 18/0253* (2013.01); *F04C 18/0269* (2013.01); *F04C 29/0057* (2013.01); *F04C 23/008* (2013.01)

(58) Field of Classification Search
CPC ..... F04C 2/025; F01C 1/0215; F01C 1/0253; F01C 1/0269; F01C 17/06
USPC ..... 418/55.1–55.6, 57, 152, 179; 464/102–103
See application file for complete search history.

(56) References Cited

FOREIGN PATENT DOCUMENTS

| | | | |
|---|---|---|---|
| JP | S58-122701 | U | 8/1983 |
| JP | H06-167284 | A | 6/1994 |
| JP | 07-324686 | A | 12/1995 |
| JP | H07-324686 | A | 12/1995 |
| JP | 2000-303969 | A | 10/2000 |
| JP | 2005-315167 | A | 11/2005 |
| JP | 2006-183527 | A | 7/2006 |
| JP | 2010-001858 | A | 1/2010 |
| JP | 2012-189043 | A | 10/2012 |

SCROLL TYPE FLUID MACHINE WITH A ROTATION STOPPING MECHANISM

CROSS-REFERENCE TO RELATED APPLICATIONS

This application is a U.S. National Stage Patent Application under 37 U.S.C. §371 of International Patent Application No. PCT/JP2014/068394, filed on Jul. 10, 2014, which claims the benefit of Japanese Patent Application No. JP 2013-157517, filed on Jul. 30, 2013, the disclosures of which are incorporated herein by reference in their entirety.

TECHNICAL FIELD

The present invention relates to a scroll type fluid machine, and particularly to a scroll type fluid machine which is suitable for being incorporated in vehicular air conditioners.

BACKGROUND ART

There is known such a scroll type fluid machine provided with a rotation stopping mechanism for stopping rotation of a movable scroll without hindering revolving movement of the movable scroll relative to a fixed scroll fixed to a casing.

For example, Patent Document 1 discloses a scroll compressor, in which a revolution-position restricting ring is interposed between a base plate on which a spiral wall of a movable scroll is uprightly installed, and a pedestal part (pressure receiving wall) of a casing (housing), which is positioned opposed to the base plate; a rotation stopping pin integrated with the revolution-position restricting ring is protruded to the base plate side and the pedestal part side; and the rotation stopping pin is loosely fitted into a restriction hole (revolution-position restricting hole) drilled in the base plate and the pedestal part.

PRIOR ART DOCUMENT

Patent Document

Patent Document 1: Japanese Patent No. 3018850

SUMMARY OF THE INVENTION

Problems to be Solved by the Invention

In the above described rotation stopping mechanism of prior art, the rotation stopping pin is passed through the revolution-position restricting ring, that is, an annular plate, to be loosely fitted into the restriction holes provided both in the base plate of the movable scroll and the pedestal part of the casing, so that rotation of the movable scroll is stopped. Therefore, a compressive reaction force of refrigerant associated with operation of the scroll compressor, and vibration acting on the movable scroll, which is caused by a driving shaft for rotating the movable scroll, are directly transmitted to the casing via the rotation stopping pin passing through the annular plate, thus releasing noise to the outside of the compressor.

Particularly, since the rotation stopping pin is typically made of high-hardness material and has a high vibration transmissibility at high frequencies, high-frequency noises are likely to occur in the casing, and there is a risk of increase, for example, in vibration and noise level in a vehicular air conditioner, in which a compressor is installed, and thus in the vehicle.

The present invention has been made in view of the above described problem, and has its object to provide a scroll type fluid machine provided with a pin & hole type, or a pin & ring type rotation stopping mechanism that can reduce noise released to the outside of the scroll type fluid machine, that is, vibration and noise level by damping vibration transmitted from the movable scroll to the casing.

Means for Solving the Problems

To achieve the above described object, a scroll type fluid machine according to an embodiment of the present invention is a scroll type fluid machine provided with a rotation stopping mechanism for stopping rotation of a movable scroll without hindering revolving movement of the movable scroll relative to a fixed scroll fixed to a casing, in which the rotation stopping mechanism includes: a support hole that is drilled in either one of a base plate on which a spiral wall of the movable scroll is uprightly installed, and a pedestal part of the casing, which is positioned opposed to the base plate; a rotation stopping pin that is fitted into the support hole and is protruded to the side of the other of the base plate and the pedestal part; a restriction hole that is drilled in the other of the base plate and the pedestal part, and is loosely fitted with the rotation stopping pin; and a buffer member interposed, at least in the support hole out of the support hole and the restriction hole, between the support hole and the rotation stopping pin.

Further, a scroll type fluid machine according to an embodiment of the present invention is a scroll type fluid machine provided with a rotation stopping mechanism for stopping rotation of a movable scroll without hindering revolving movement of the movable scroll relative to a fixed scroll fixed to a casing, wherein the rotation stopping mechanism includes: a buffer member that is an annular plate disposed between a base plate on which a spiral wall of the movable scroll is uprightly installed, and a pedestal part of the casing, which is positioned opposed to the base plate; a first support hole that is drilled in the buffer material; a first rotation stopping pin that is fitted into the first support hole, and is protruded to the side of either one of the base plate and the pedestal part; a first restriction hole that is drilled in either one of the base plate and the pedestal part, and is loosely fitted with the rotation stopping pin; and restriction means for restricting movement of the buffer material relative to the other of the base plate and the pedestal.

In the invention according to an embodiment, the restriction means includes: a second support hole that is drilled in the buffer member; a fixed pin that is fitted into the second support hole, and is protruded to the side of the other of the base plate and the pedestal part; and a third support hole that is drilled in the other of the base plate and the pedestal part, and is fitted with the fixed pin.

In the invention according to an embodiment, the restriction means includes: a second support hole that is drilled in the buffer member; a second rotation stopping pin that is fitted into the second support hole, and is protruded to the side of the other of the base plate and the pedestal part; and a second restriction hole that is drilled in the other of the base plate and the pedestal part, and is loosely fitted with the second rotation stopping pin.

In the invention according to an embodiment, the buffer member is formed of a material having a vibration damping rate higher than that of the rotation stopping pin.

The invention according to an embodiment includes a back pressure structure, wherein as a result of revolving movement of the movable scroll relative to the fixed scroll, a back pressure chamber for working fluid including lubricant oil is formed between the pedestal part and the buffer member, and the movable scroll is pressed and biased against the fixed scroll via the buffer member by the back pressure chamber.

Advantageous Effects of the Invention

According to the scroll type fluid machine recited in an embodiment of the present invention, as a result of a buffer member being interposed, at least in a support hole out of the support hole and the restriction hole of the rotation stopping pin, between the support hole and the rotation stopping pin, it is possible to damp vibration transmitted from the movable scroll to the casing via the rotation stopping pin, at the buffer member. Thus, it is possible to reduce noise released to the outside of the scroll type fluid machine, and thus reduce vibration and noise level caused by the aforementioned noise so that noise characteristics of the scroll type fluid machine can be significantly improved.

According to the scroll type fluid machine recited in an embodiment of the present invention, the buffer member, which is an annular plate, is disposed between the base plate, on which the spiral wall of the movable scroll is uprightly installed, and the pedestal part of the casing, which is positioned opposed to the base plate, and the first rotation stopping pin is protruded from the buffer member to either one of the base plate and the pedestal part to be loosely fitted into the first restriction hole, thereby restricting movement of the buffer member relative to the other of the base plate and the pedestal part by restriction means. Even in this case, it is possible to damp vibration transmitted from the movable scroll to the casing via the rotation stopping pin at the buffer member, and thus reduce noise released to the outside of the scroll type fluid machine, thus reducing vibration and noise level caused by the aforementioned noise so that noise characteristics of the scroll type fluid machine can be significantly improved.

According to the invention recited in an embodiment, specifically, the restriction means fixes the buffer member with the fixing pin to the other of the base plate and the pedestal part via the second and third support holes.

On the other hand, according to the invention recited in an embodiment, the restriction means may be made up of the second support hole, the second rotation stopping pin, and the second restriction hole, and made to function as a part of the rotation stopping mechanism.

According to the invention recited in an embodiment, since the buffer member is made of a material having a vibration damping rate higher than that of the rotation stopping pin, and accordingly the rotation stopping pin is generally made of high-hardness material and has a high vibration transmissibility for high-frequency noises, it is possible to effectively reduce high-frequency noises released from the scroll type fluid machine.

According to the invention recited in an embodiment, since the pedestal part and the buffer member can be separated by the pressure of the back pressure chamber of the back pressure structure, it is possible to damp vibration transmitted from the movable scroll to the casing not only at the buffer member, but also at the back pressure chamber, and further to reduce noise released to the outside of the scroll type fluid machine, thus further reducing vibration and noise level caused by the aforementioned noise so that noise characteristics of the scroll type fluid machine can be further significantly improved.

MODE FOR CARRYING OUT THE INVENTION

Hereafter, an embodiment of the present invention will be described based on the drawings.

Example 1

Figure 1:
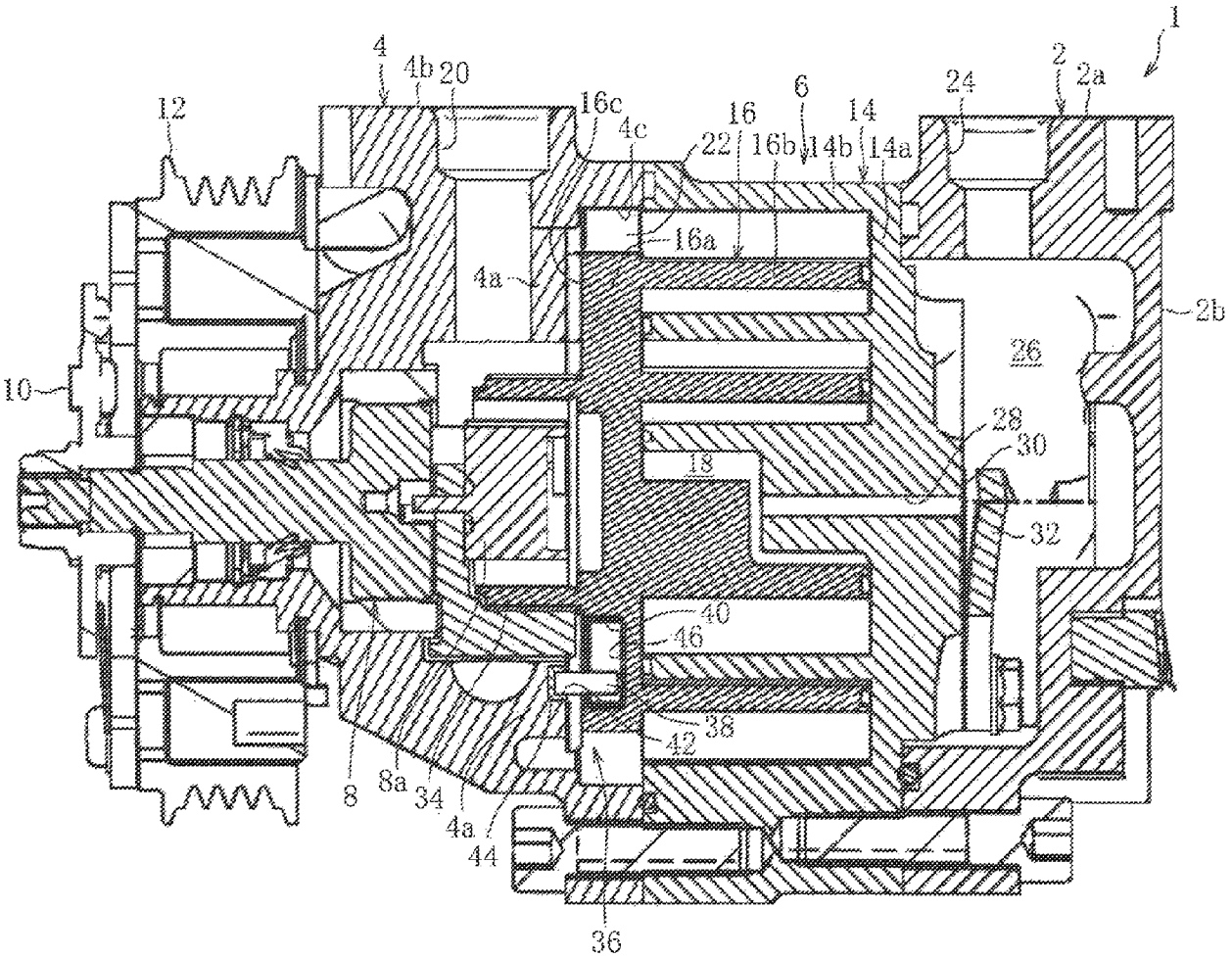
FIG. 1 is a longitudinal sectional view of a scroll compressor relating to Example 1 of the present invention.

As shown in FIG. 1, the scroll type fluid machine relating to the present example is a scroll compressor, in which a compressor 1 is incorporated, for example, in a refrigeration circuit of a vehicular air conditioner, which is mounted on a vehicle not shown. The circuit includes a refrigeration circulation path for a refrigerant which is the working fluid of the compressor 1, and the compressor 1 sucks in refrigerant from a backward passage of the refrigerant circulation path, and compresses the refrigerant and discharges it to a forward passage.

The above described compressor 1 includes a rear casing 2 and a front casing 4, and a scroll unit 6 is disposed between the rear casing 2 and the front casing 4. A driving shaft 8 extends in the front casing 4, and the driving shaft 8 is rotatably supported by the front casing 4 via a bearing.

A driving pulley 12 having an electromagnetic clutch 10 built-in is attached to a protruding end from the front casing 4 of the driving shaft 8, and the driving pulley 12 is rotatably supported by front casing 4 via a bearing. Power of a vehicular engine is transferred to the driving pulley 12 via a driving belt not shown, and the rotation of the driving pulley 12 can be transferred to the driving shaft 8 via the electromagnetic clutch 10. Therefore, when the electromagnetic clutch 10 is turned on while the engine is driven, the driving shaft 8 rotates integrally with the driving pulley 12.

On the other hand, the scroll unit 6 is made up of a fixed scroll 14 held between the rear casing 2 and the front casing 4, and a movable scroll 16 assembled to the fixed scroll 14 so as to mesh therewith.

The movable scroll 16 includes a base plate 16*a*, and a spiral wall 16*b* is installed in the base plate 16*a* uprightly toward the fixed scroll 14. A back face 16*c* of the base plate 16*a* of the movable scroll 16 is positioned opposed to the pedestal part 4*a* formed inward of the front casing 4.

The base plate 14*a* of the fixed scroll 14 is also installed with a spiral wall 14*b* uprightly toward the base plate 16*a* of the movable scroll 16, and respective spiral walls 14*b* and 16*b* of the fixed scroll 14 and the movable scroll 16 mesh with each other in an opposed manner, so that a compression chamber 18 for refrigerant, which is the working fluid including lubricant oil of the compressor 1, is formed, and the volume of the compression chamber 18 is increased or decreased according to the revolving movement of the movable scroll 16 relative to the fixed scroll 14.

An intake port 20 is opened in an outer peripheral wall 4*b* of the front casing 4, and the intake port 20 is made to communicate with the above described backward passage of the refrigerant circulation path. Further, an intake chamber 22 for refrigerant, which is in communication with the intake port 20, is formed between an inner peripheral wall 4*c* of the front casing 4 and the movable scroll 16.

On the other hand, a discharge port 24 is opened in the outer peripheral wall 2*a* of the rear casing 2, and this discharge port 24 is made to communicate with the forward passage of the refrigerant circulation path. A discharge chamber 26, which is in communication with the discharge port 24, is formed between the fixed scroll 14 and an end wall 2*b* of the rear casing 2, and the discharge chamber 26 is made to communicate with the compression chamber 18 via a discharge hole 28, which is drilled in the base plate 14*a* of the fixed scroll 14. A discharge valve 30 for opening/closing the discharge hole 28 is disposed in the discharge chamber 26, and the discharge valve 30 is restricted in its degree of opening by a stopper plate 32.

Further, a boss 34 is formed in the back face 16*c* of the base plate 16*a* of the movable scroll 16. The boss 34 is rotatably supported by an eccentric shaft part 8*a* of the driving shaft 8 via a bearing, and rotation of the driving shaft 8 imparts revolving movement on the movable scroll 16. Further, a rotation stopping mechanism 36 for stopping rotation of the movable scroll 16 without hindering revolving movement of the movable scroll 16 relative to the fixed scroll 14 is disposed between the base plate 16*a* of the movable scroll 16 and the pedestal part 4*a* of the front casing 4.

Then, according to the above described compressor 1, the movable scroll 16 undergoes revolving movement, without being rotated, on the pedestal part 4*a* of the front casing 4 so that refrigerant sucked into the scroll unit 6 via the intake port 20 forms a compression chamber 18, and the refrigerant in the compression chamber 18 is compressed while being moved toward a center of the scroll unit 6, and thereafter is discharged to the discharge chamber 26 via the discharge hole 28, thereby being fed to the outside of the compressor 1 via the discharge port 24.

Where, the rotation stopping mechanism 36 of the present example is a pin & ring type mechanism including, for example, 6 sets of rotation stopping pins 38 and restriction rings 40, in which a support hole 42 corresponding to each rotation stopping pin 38 is drilled in the pedestal part 4*a* of the front casing 4, and each rotation stopping pin 38 is respectively fitted into each support hole 12 via a buffer member 44 to be supported, thereby being made to protrude to the side of the base plate 16*a* of the movable scroll 16.

While the rotation stopping pin 38 is formed of a high-hardness material such as SUJ2 (high-carbon Cr bearing steel), and has a high vibration transmissibility for particularly high-frequency noises, the buffer member 44 has a vibration transmissibility lower than that of the rotation stopping pin 38 such as of an aluminum alloy, in other words, is formed of a material having a higher vibration damping rate than that of the rotation stopping pin 38.

On the other hand, the restriction ring 40 is formed of high-hardness material similar to that of the rotation stopping pin 38, and is fitted into a bottomed shape restriction hole 46 which is drilled in the base plate 16*a* of the movable scroll 16. The rotation stopping pin 38 is loosely fitted into the restriction hole 46 in its radial direction via a restriction ring 40, and is slid on the restriction ring 40 as a result of revolving motion of the movable scroll 16 relative to the fixed scroll 14.

As so far described, in the present example, as a result of the buffer member 44 being interposed, in the support hole 42, between the support hole 42 and the rotation stopping pin 38, it becomes possible to damp, at the buffer member 44, the vibration transmitted from the movable scroll 16 to the front casing 4 through the rotation stopping pin 38. Therefore, it is possible to reduce noise released to the outside of the compressor 1, that is, vibration and noise level, thereby significantly improving noise characteristics of the compressor 1.

Further, since the buffer member 44 is formed of a material having a higher vibration damping rate than that of the rotation stopping pin 38, and thus, the rotation stopping pin 38 is formed of a high-hardness material, thereby having a high vibration transmissibility for high frequency noises, it is possible to effectively reduce high frequency noise released from the compressor 1.

Example 2

Figure 2:
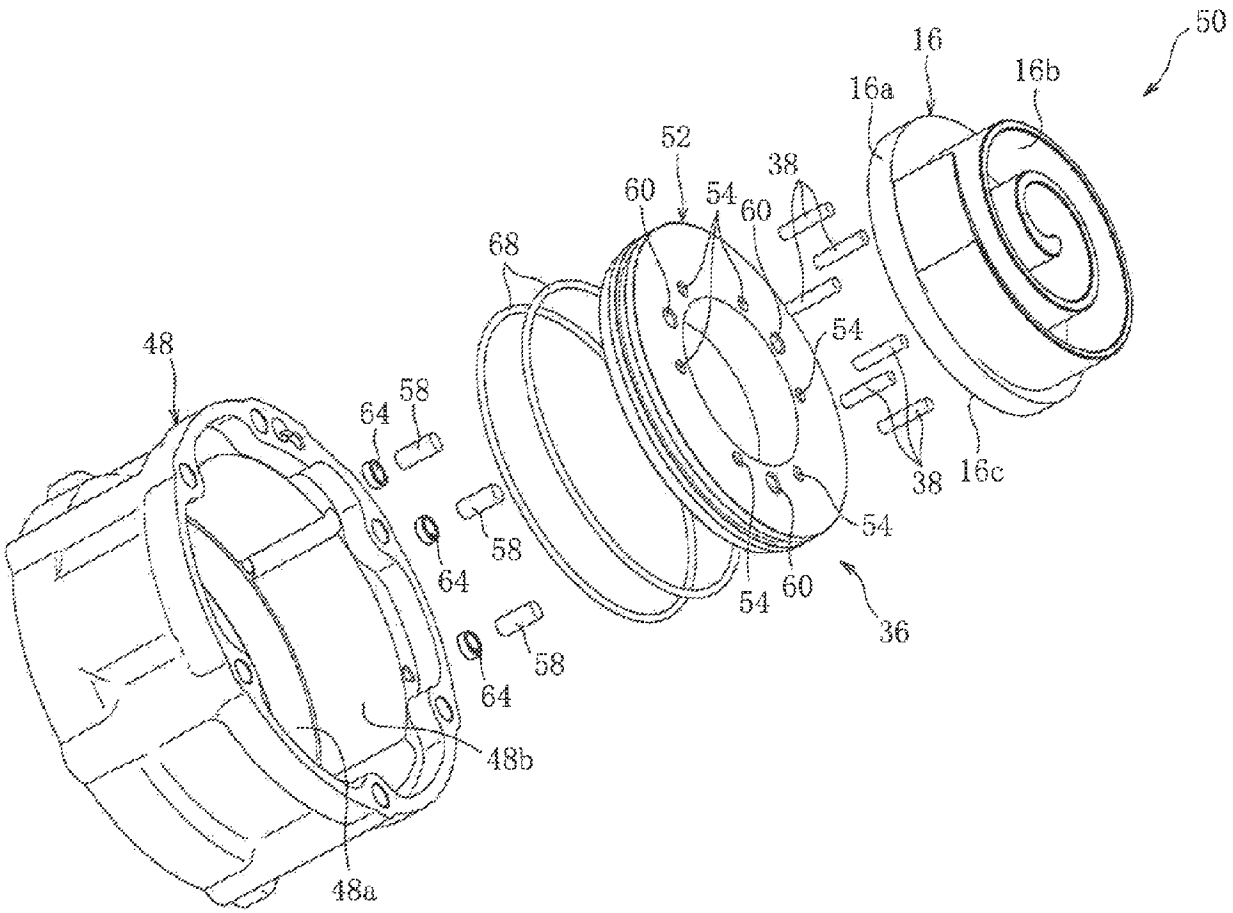
FIG. 2 is an exploded perspective view to show the inside of a center casing of a scroll compressor relating to Example 2 of the present invention.
Figure 3:
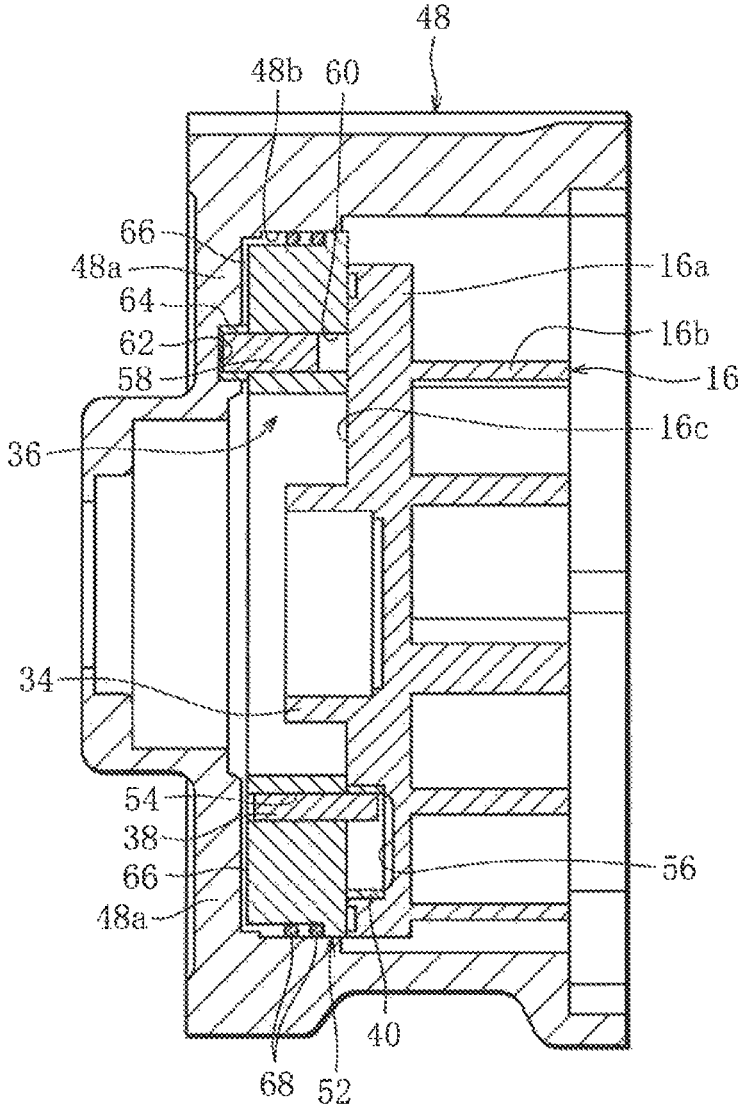
FIG. 3 is a longitudinal sectional view of the inside of the center casing of FIG. 2.

As shown in FIG. 2 and the scroll type fluid machine relating to the present example is a scroll compressor 50 including a center casing 48 as a part of a container, and components similar to those of Example 1 will be given like symbols, thereby omitting description thereof.

The compressor 50 drives the driving shaft 8 to rotate by an electric motor not shown and arranged in the container, and forms a back pressure structure for refrigerant including lubricant oil in the back face 16*c* of the base plate 16*a* of the movable scroll 16.

In the present example, an annular plate 52 is disposed between the base plate 16*a* of the movable scroll 16 and a pedestal part 48*a* of the center casing 48, which is positioned opposed to the base plate 16*a*, and the annular plate 52 is, like the buffer member 44 of Example 1, formed of a material having a vibration transmissibility lower than at least that of the rotation stopping pin 38, in other words, a material having a vibration damping rate higher than at least that of the rotation stopping pin 38, such as an aluminum alloy, synthetic resin, ceramics, etc.

A first support hole 54 is respectively drilled in the annular plate 52 corresponding to each rotation stopping pin 38, and each rotation stopping pin 38 is fitted into and supported by each first support hole 54 and is made to protrude to the side of the base plate 16*a* of the movable scroll 16.

On the other hand, the restriction ring 40 is formed of a high-hardness material similar to that of the rotation stopping pin 38, and fitted into a first restriction hole 56 which has a bottomed shape and is drilled in the base plate 16*a* of the movable scroll 16. The rotation stopping 38 is loosely fitted into the first restriction hole 56 via the restriction ring 40 in its radial direction, and is slid on the restriction ring 40 by the revolving motion of the movable scroll 16 relative to the fixed scroll 14.

Further, the annular plate 52 is restricted in its movement relative to the pedestal part 48*a* of the center casing 48 by, for example, three fixing pins 58 (restriction means). Specifically, a second support hole 60 corresponding to each fixing pin 58 is drilled in the annular plate 52, and each fixing pin 58 is fitted into and supported by each second support hole 60 respectively, and is made to protrude to the pedestal part 48*a* side.

A third support hole 62 corresponding to each fixing pin 58 is drilled in the pedestal part 48*a*, and each fixing pin 58 is fitted into each third support hole 62 via a fixing ring 64, respectively.

The fixing ring 64 is formed of a high-hardness material similar to that of the rotation stopping pin 38, and has an inner diameter which allows fitting of the rotation stopping pin 38 with a predetermined fitting dimension such as intermediate fitting. As a result of this, as the pressure of a back pressure chamber 66, which is formed between the pedestal part 48*a* and the annular plate 52 as the above described back pressure structure, increases, the rotation stopping pin 38 and the annular plate 52, into which the rotation stopping pin 38 has been fitted, are allowed to move slightly in the axial direction of the driving shaft 8 relative to the movable scroll 16 so that the pressure of the back pressure chamber 66 causes the movable scroll 16 to be pressed and biased against the fixed scroll 14 via the annular plate 52.

In such a back pressure structure, the annular plate 52 is air-tightly mounted to the inner peripheral wall 48*b* of the center casing 48 via, for example, two O-rings 68, and refrigerant of the intake chamber and the discharge chamber, which are not shown and provided in the compressor 50, is appropriately introduced so that the pressure of the back pressure chamber 66 is appropriately adjusted.

As so far described, in the present example, as a result of the annular plate 52 disposed between the base plate 16*a* of the movable scroll 16 and the pedestal part 48*a* of the center casing 48, it is made possible to damp, at the annular plate 52, the vibration transmitted from the movable scroll 16 to the center casing 48 through the rotation stopping pin 38 as in the case of Example 1. Thus, it is possible to reduce noise released to the outside of the compressor 50, that is, vibration and noise level, thereby significantly improving the noise characteristics of the compressor 50.

Further, since the annular plate 52 is formed of a material having a higher vibration damping rate than that of the rotation stopping pin 38, and as a result, the rotation stopping pin 38 is formed of a high-hardness material, thereby having a high vibration transmissibility for high frequency noises, it is possible to effectively reduce high-frequency noise emitted from the compressor 1.

Further, when there is a back pressure structure in the back face 16*c* of the movable scroll 16 as in the compressor 50, since the pedestal part 48*a* and the annular plate 52 can be separated by the pressure of the back pressure chamber 66, it is possible to damp the vibration transmitted from the movable scroll 16 to the center casing 48 not only at the annular plate 52, but also in the back pressure chamber 66, thus enabling further reduction of noise released to the outside of the compressor 50, that is, vibration and noise level, thus further significantly improving the noise characteristics of the compressor 50.

While description of each example of the present invention will be finished, the present invention will not be limited to each example described above, and various alterations can be made to the present invention within a range not departing from the spirit thereof.

For example, in Example 1, the buffer member 44 may be interposed not only around the support hole 42, but also around the restriction hole 46 which includes the restriction ring 40, and in this case, it is possible to further effectively damp vibration transmitted from the movable scroll 16 to the front casing 4 via the rotation stopping pin 38.

Moreover, in Example 1, the support hole 42 may be provided in the base plate 16*a* of the movable scroll 16, and the restriction hole 46 may be provided in the pedestal part 4*a* of the front casing 4. Even in such a case, interposing the buffer member 44, at least in a support hole 42 out of the support hole 42 and the restriction hole 46, between the support hole 42 and the rotation stopping pin 38 will make it possible to damp vibration transmitted from the movable scroll 16 to the front casing 4 through the rotation stopping pin 38.

Further, in Example 2, various techniques are conceivable as the means for restricting the movement of the annular plate 52 without being limited to the fixing pin 58. For example, as another example of restriction means of movement of the annular plate 52, this restriction means may be a second rotation stopping mechanism different from the rotation stopping mechanism 36.

Specifically, a second support hole is drilled in the annular plate 52, respectively corresponding to a second rotation stopping pin different from the rotation stopping pin 38, and each second rotation stopping pin is fitted into and supported by each second support hole and is protruded to the pedestal part 48*a* side. On the other hand, a second restriction ring similar to the restriction ring 40 is fitted into a second restriction hole which has a bottomed shape and is drilled in the pedestal part 48*a*, and the second rotation stopping pin is loosely fitted into the second restriction hole via the second restriction ring.

Moreover, in Example 2, while the first restriction hole 56 is provided in the pedestal part 48*a*, a third support hole 62 may be provided in the base plate 16*a* so that the annular plate 52 is fixed to the movable scroll 16 side with the fixing pin 58. In this case, the above described second rotation stopping mechanism is configured such that the protruding direction of the second rotation stopping pin and the forming position of the second restriction hole are reversed. Even in such a case, interposing the annular plate 52 between the rotation stopping pin 38 and the pedestal part 48*a* will make it possible to damp vibration transmitted from the movable scroll 16 to the center casing 48 through the rotation stopping pin 38.

Moreover, the numbers and diameters of the rotation stopping pins 38 and the fixing pins 58 that constitute the rotation stopping mechanism 36, and the size relationship between diameters of the rotation stopping pin 38 and the fixing pin 58, and each support hole and each restriction hole will not be limited to the illustrated form.

Further, the material of the buffer member 44 and the annular plate 52 may be, for example, synthetic resin, ceramics, etc. without being limited to aluminum alloy, provided that it has a vibration damping rate higher than at least that of the rotation stopping pin 38.

Further, in the above, described each example and variation, although description has been made on the scroll compressor 1 driven by an engine and incorporated in a vehicular air conditioner, and the scroll compressor 50 driven by an electric motor, the present invention will not be limited to these, and can be applied to scroll type fluid machines in general such as compressors and expanders in various fields, which use various working fluids.

EXPLANATION OF REFERENCE SIGNS

1 Scroll compressor (Scroll type fluid machine)
4 Front casing (Casing)
4*a* Pedestal part
14 Fixed scroll
16 Movable scroll
16*a* Base plate
16*b* Spiral wall
36 Rotation stopping mechanism
38 Rotation stopping or (First rotation stopping pin)
42 Support hole

44 Buffer member
46 Restriction hole
48 Center casing (Casing)
48*a* Pedestal part
50 Scroll compressor (Scroll type fluid machine)
52 Annular plate (Buffer member)
54 First support hole
56 First restriction hole
58 Fixing pin (Restriction means)
60 Second support hole (Restriction means)
62 Third support hole (Restriction means)
66 Back pressure chamber

The invention claimed is:

1. A scroll type fluid machine provided with a rotation stopping mechanism for stopping rotation of a movable scroll without hindering revolving movement of the movable scroll relative to a fixed scroll fixed to a casing, wherein the rotation stopping mechanism comprises:

a buffer member that is an annular plate disposed between a base plate on which a spiral wall of the movable scroll is uprightly installed, and a pedestal part of the casing, which is positioned opposed to the base plate;

a first support hole that is drilled in the buffer member;

a first rotation stopping pin that is fitted into the first support hole, and is protruded to the side of either one of the base plate and the pedestal part;

a first restriction hole that is drilled in either one of the base plate and the pedestal part, and is loosely fitted with the first rotation stopping pin; and restriction means for restricting movement of the buffer member relative to the other of the base plate and the pedestal, wherein the restriction means comprises:

a second support hole that is drilled in the buffer member;

a fixed pin that is fitted into the second support hole, and is protruded to the side of the other of the base plate and the pedestal part; and a third support hole that is drilled in the other of the base plate and the pedestal part, and is fitted with the fixed pin, wherein the buffer member is formed of a material having a vibration damping rate higher than that of the first rotation stopping pin.

2. The scroll type fluid machine according to claim 1, wherein the restriction means comprises:

a second support hole that is drilled in the buffer member;

a second rotation stopping pin that is fitted into the second support hole, and is protruded to the side of the other of the base plate and the pedestal part; and a second restriction hole that is drilled in the other of the base plate and the pedestal part, and is loosely fitted with the second rotation stopping pin.

3. The scroll type fluid machine according to claim 1, comprising a back pressure structure, wherein as a result of revolving movement of the movable scroll relative to the fixed scroll, a back pressure chamber for working fluid including lubricant oil is formed between the pedestal part and the buffer member, and the movable scroll is pressed and biased against the fixed scroll via the buffer member by the back pressure chamber.

* * * * *